US008764083B2

(12) United States Patent
Belder et al.

(10) Patent No.: US 8,764,083 B2
(45) Date of Patent: Jul. 1, 2014

(54) CLAMPING DEVICE

(75) Inventors: Cornelis Belder, Oudewater (NL); Klaas-Jan Mulderij, HK Delfgauw (NL)

(73) Assignee: IHC Norex B.V., Sliedrecht (NL)

( * ) Notice: Subject to any disclaimer, the term of this patent is extended or adjusted under 35 U.S.C. 154(b) by 0 days.

(21) Appl. No.: 13/978,454

(22) PCT Filed: Jan. 6, 2012

(86) PCT No.: PCT/NL2012/050009

§ 371 (c)(1),
(2), (4) Date: Aug. 5, 2013

(87) PCT Pub. No.: WO2012/093940

PCT Pub. Date: Jul. 12, 2012

(65) Prior Publication Data

US 2013/0307282 A1 Nov. 21, 2013

(30) Foreign Application Priority Data

Jan. 7, 2011 (NL) ..... 2005967

(51) Int. Cl.
*B66C 1/42* (2006.01)
*B66C 1/44* (2006.01)
*B66C 1/10* (2006.01)

(52) U.S. Cl.
CPC ..... *B66C 1/442* (2013.01); *B66C 1/108* (2013.01); *B66C 1/44* (2013.01)
USPC ..... 294/81.61; 294/106

(58) Field of Classification Search
USPC ..... 294/81.61, 103.1, 67.1, 67.3, 67.33, 90, 294/93, 104, 106
See application file for complete search history.

(56) References Cited

U.S. PATENT DOCUMENTS

| | | | | |
|---|---|---|---|---|
| 270,158 | A | 1/1883 | Van | |
| 2,327,005 | A | 8/1943 | Babcock et al. | |
| 3,401,973 | A * | 9/1968 | Marshall | 294/93 |
| 4,320,915 | A | 3/1982 | Abbott et al. | |
| 5,161,845 | A * | 11/1992 | Carpenter, Jr. | 294/90 |
| 5,171,053 | A * | 12/1992 | Rouleau | 294/106 |
| 5,306,062 | A | 4/1994 | Dodge | |
| 5,476,300 | A * | 12/1995 | Dodge | 294/81.21 |
| 5,797,638 | A * | 8/1998 | Yamazaki et al. | 294/97 |
| 6,270,158 | B1 * | 8/2001 | Hong | 297/284.4 |
| 2001/0001525 | A1 | 5/2001 | Shepard et al. | |

FOREIGN PATENT DOCUMENTS

| | | | |
|---|---|---|---|
| EP | 0 402 231 | A1 | 12/1990 |
| FR | 2 619 800 | A1 | 3/1989 |
| GB | 2 224 481 | A | 5/1990 |
| NL | 8 403 445 | A | 6/1986 |

OTHER PUBLICATIONS

International Search Report, dated Apr. 20, 2012, from corresponding PCT application.

* cited by examiner

*Primary Examiner* — Paul T Chin
(74) *Attorney, Agent, or Firm* — Young & Thompson

(57) ABSTRACT

Disclosed is a clamping device for clamping a tubular member, like a thin walled tube or a pile, having a tube wall and provided with a flange at a tube end, and for hoisting the tubular member while being clamped only at its flange with the clamping device, wherein the clamping device includes: at least two clamping elements for engaging the internal flange and clamping the flange; and a clamping device frame that fixedly joins the at least two clamping elements for maintaining mutual position of the at least two clamping elements while hoisting the tubular member.

20 Claims, 3 Drawing Sheets

CLAMPING DEVICE

BACKGROUND

The present invention relates to a clamping device for clamping a tubular member, like thin walled tube or a well platform or windmill supporting pile, and for hoisting said tubular member clamped with the clamping device.

Such a clamping device is known from U.S. Pat. No. 4,320,915 A wherein an internal elevator is disclosed, the elevator to be received within and internally grip and support a tubular member such as a well platform supporting pile, and including slips preferably mounted within openings in an outer body and actuable radially outwardly into gripping engagement with the tubular member by powered axial movement of an inner camming body.

Such a clamping device is also known from GB 2224481 A which discloses an internal elevator for lifting a pipe or pile and comprises a plurality of gripper assemblies which are radially movable into engagement with the interior wall of the pipe or pile.

EP 0 402 231 A1 discloses a device for clamping a rim of a tun which device has clamping members which translate relative to each other and approach the rim sideward.

U.S. Pat. No. 2,327,005 A discloses a barrel lifting means which engage the upright chime of the barrel sideward.

U.S. 2001/001525 A1 discloses an apparatus for lifting a load having an upright tubular sidewall. The apparatus has a plurality of clamps constructed and disposed to grip portions of the tubular sidewall. The clamps move sideward relative to the sidewall.

NL 8 403 445 A discloses a device for engaging an upright rim of a tun between clamping members.

These known clamping devices are not suitable for being received within a tubular member provided with an internal flange at its ends and subsequently clamp and hoist the tubular member, in particular clamp the internal flange and hoist the tubular member via the internal flange. In addition these known clamping devices add up significantly to the weight to be hoisted in case of hoisting tubular elements with a large diameter.

It is known to clamp flanges in general. However clamping a flange of a pile for supporting windmill leads to unacceptable stresses in at least the transition section between the flange and the wall of the tubular member.

SUMMARY OF THE INVENTION

The invention aims to provide a clamping device for clamping a tubular member, wherein at least a problem associated with known clamping devices is at least partly solved.

Another object of the invention is to provide an alternative clamping device.

According to a first aspect of the invention this is realized with a clamping device for clamping a tubular member, like a thin walled tube or a pile, having a tube wall and provided with a flange at a tube end, and for hoisting said tubular member while clamped only at its flange with the clamping device, wherein the clamping device comprises;

at least two clamping means for engaging the flange and clamping the flange, a clamping device frame that fixedly joins the at least two clamping means for maintaining mutual position of the at least two clamping means while hoisting the tubular member, and wherein the at least two clamping means are arranged and distributed along an imaginary outer circumference of the clamping device for clamping the tubular member at its flange such that the tubular member hangs down in a substantially vertical position when hoisting the tubular member, wherein each of the at least two clamping means comprise;

a first clamping member provided with an upper clamping shoe for engaging the upper side of the flange, a second clamping member hingedly coupled with the first clamping member and provided with a lower clamping shoe for engaging the lower side of the flange, wherein the first and second clamping members are mutually hingeable around a hinging axis between an open position for receiving the flange between the upper and lower clamping shoes, and a closed position for clamping the flange between the upper and lower clamping shoes, a coupling member for coupling the clamping device with a hoisting element like a cable or a link plate, and applying a hoisting force to the clamping device, wherein the coupling member is provided with the first clamping member and the hinging axis being arranged between the coupling member and the upper clamping shoe for applying a clamping force at the flange when the hoisting force is applied at the coupling member, wherein the coupling member and the upper and lower clamping shoes are arranged with respect to the hinging axis for subjecting the flange at its transition section with wall of the tubular member substantially only to tensile stress when hoisting the tubular member with the clamping device.

The clamping device according to the invention may be beneficially applied to both an internal or an external flange of a tubular member. The orientation of a clamping means needs to be adapted accordingly to respectively radially outwardly of radially inwardly towards the flange of the tubular member.

In an embodiment of the clamping device according to the invention, the second clamping member extends past the upper clamping shoe for engaging the flange with the lower clamping shoe more close to the tube wall then the upper clamping shoe for even more reducing bending stresses in the tubular member.

In an embodiment, the clamping device according to the invention comprises a stop surface for arranging the clamping device relative to the tube wall for positioning the upper and lower clamping shoes relative to the flange, and preferably for spacing a lower clamping shoe centre a wall spacing y away from a tube wall centre, such that the flange at a transition section between the flange and the tube wall is subjected substantially only to tensile stress. The stop surface may engage the inner and/or outer circumference of the tube wall for arranging the clamping device relative to the tube wall.

In an embodiment of the clamping device according to the invention, seen in radial direction, a coupling means centre is spaced a coupling means lever a from the hinging axis, an upper clamping shoe centre is spaced an upper clamping shoe lever b from the hinging axis, and the lower clamping shoe centre is spaced a clamping shoe spacing x from the upper clamping shoe centre, wherein the ratio between the coupling means lever a and the upper clamping shoe lever b corresponds with the ratio of the wall spacing (y) and the clamping shoe spacing (x) for subjecting the flange at its transition section with the tube wall of the tubular member substantially only to tensile stress when hoisting the tubular member with the clamping device.

In an embodiment, the clamping device according to the invention comprises a number of stop surfaces for centring the clamping device within the tubular member for positioning the upper and lower clamping shoes for engaging the flange of the tubular member therewith.

In an embodiment of the clamping device according to the invention, the second clamping member of at least one of the at least two clamping means, which second clamping member is provided with the lower clamping shoe, is slideably coupled with the clamping device frame, and wherein the second clamping member is slideable radially relative to the imaginary outer circumference of the clamping device between a retracted position for moving the second clamping member past the flange, and an extended position for the lower clamping shoe facing the lower side of the flange.

In an embodiment of the clamping device according to the invention, the clamping device frame comprises an accommodation for slideably accommodating at least partly the second clamping member therein, and for coupling the second clamping member with the clamping device frame for closing lines of force for clamping the flange when the second clamping member is in its extended position. This embodiment is beneficial in terms level of integration and consequently weight and dimensions of the clamping device.

In an embodiment of the clamping device according to the invention, the accommodation is integrally formed with the clamping device frame which is beneficial in terms of strength and weight of the clamping device frame.

In an embodiment of the clamping device according to the invention, the first clamping member extends entirely above the second clamping member, which enables e.g. an actuator to be placed between the first and second clamping member.

In an embodiment, the clamping device according to the invention comprises an actuator coupled with both the first and second clamping member for pre-clamping the flange of the tubular member between the lower and upper clamping shoe before hoisting the tubular member by means of the clamping device, or for forcing the first and second clamping members towards the open position.

In an embodiment of the clamping device according to the invention, the actuator is provided between the first and second clamping member, which is robust and space saving.

In an embodiment, the clamping device according to the invention comprises a spacing member for mutually spacing the first and second clamping member at a distance such that the first and second clamping members extend substantially parallel when clamping the flange between the lower and upper clamping shoe.

In an embodiment of the clamping device according to the invention, the distance substantially corresponds with a flange thickness of the flange which is beneficial for engaging the flange with the upper an lower clamping shoes.

The invention further relates to an assembly of a clamping device according to the invention and a tubular member clamped with the clamping device at a flange of the tubular member.

The invention further relates to method for hoisting a flanged tubular member using a clamping device according to the invention, comprising the step, moving the lower clamping shoe radially towards the tube wall.

The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DESCRIPTION OF THE DRAWINGS

The invention will be further elucidated referring to an embodiment of the clamping device according to the invention shown in the drawings wherein shown in.

DETAILED DESCRIPTION OF EMBODIMENTS

The embodiment will now be described referring to all the FIGS. 1-4.

Figure 1:
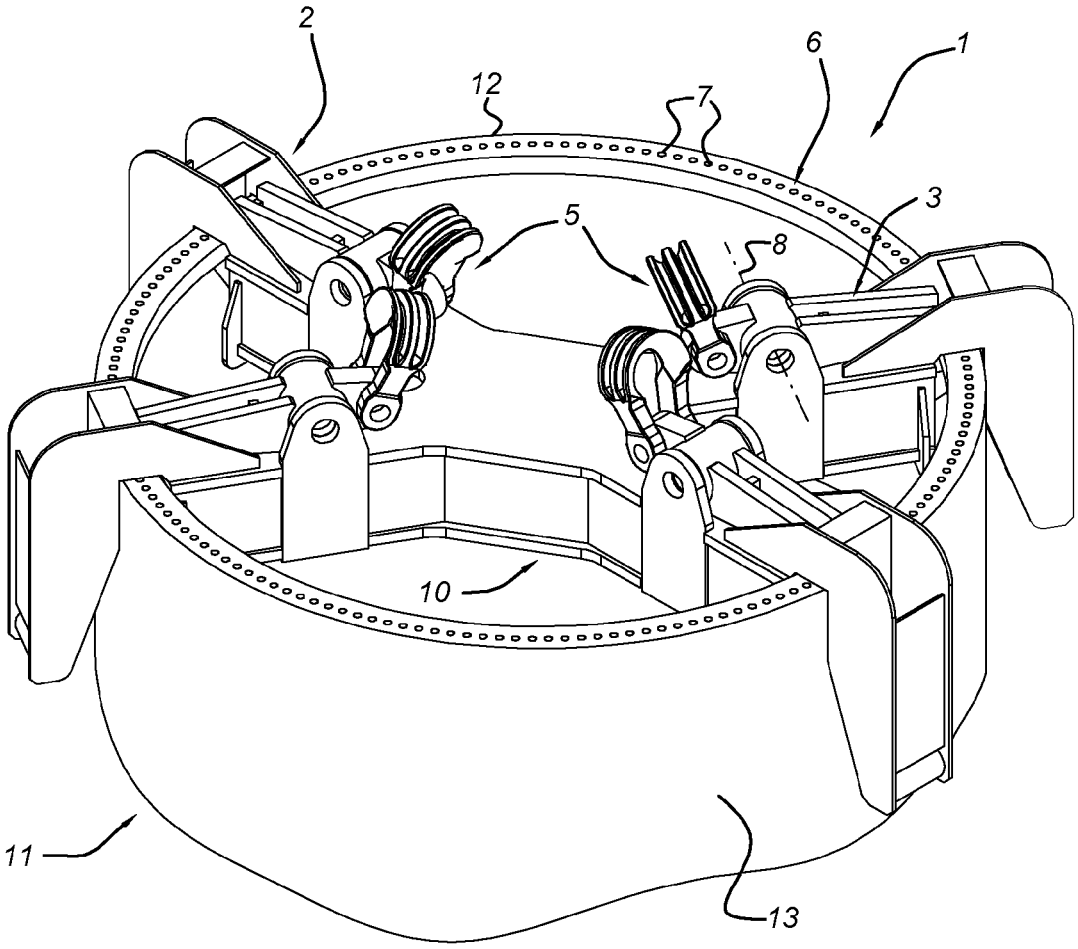
FIG. 1 in perspective view an assembly of a clamping device and a tubular member.
Figure 2:
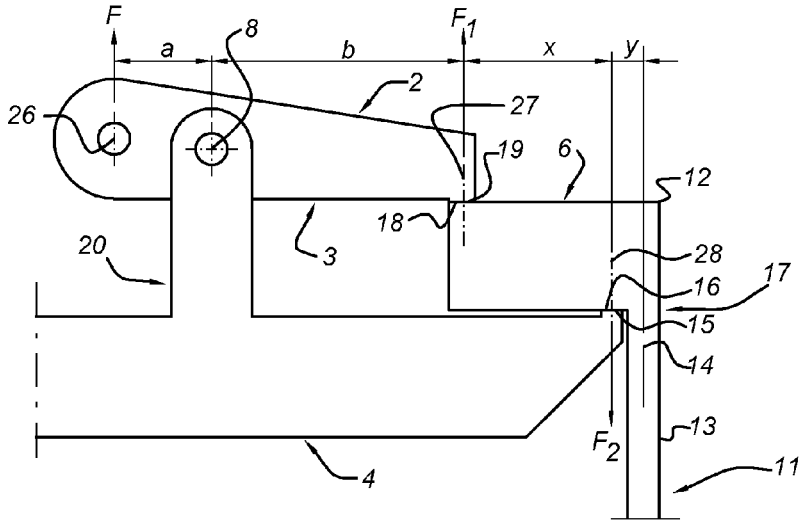
FIG. 2 a schematic side view of clamping means of the clamping device.
Figure 3:
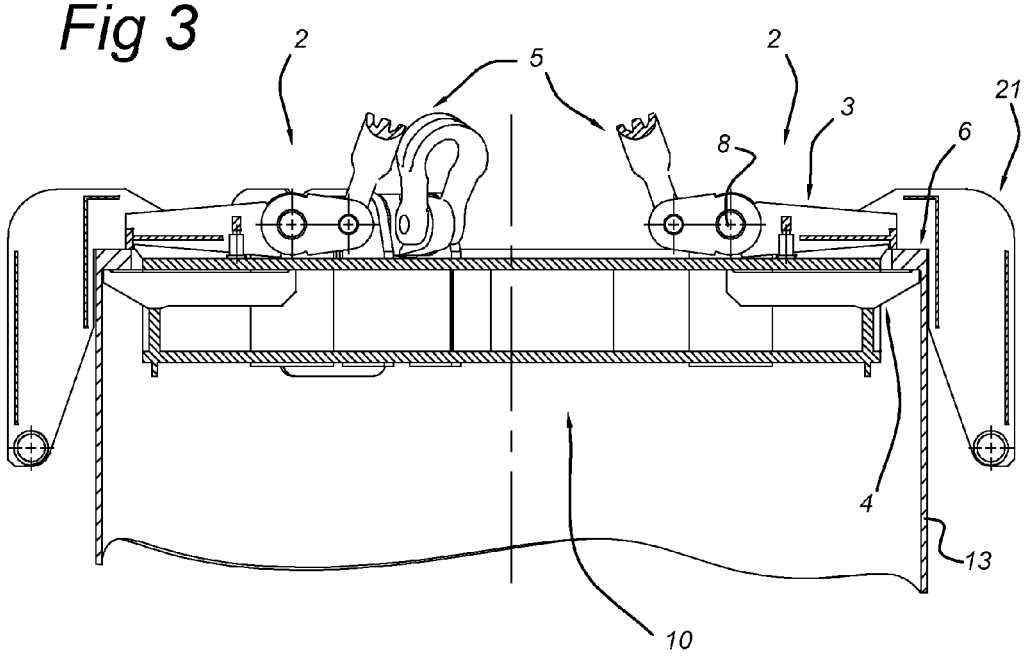
FIG. 3 a cross sectional side view of the assembly of FIG. 1.
Figure 4:
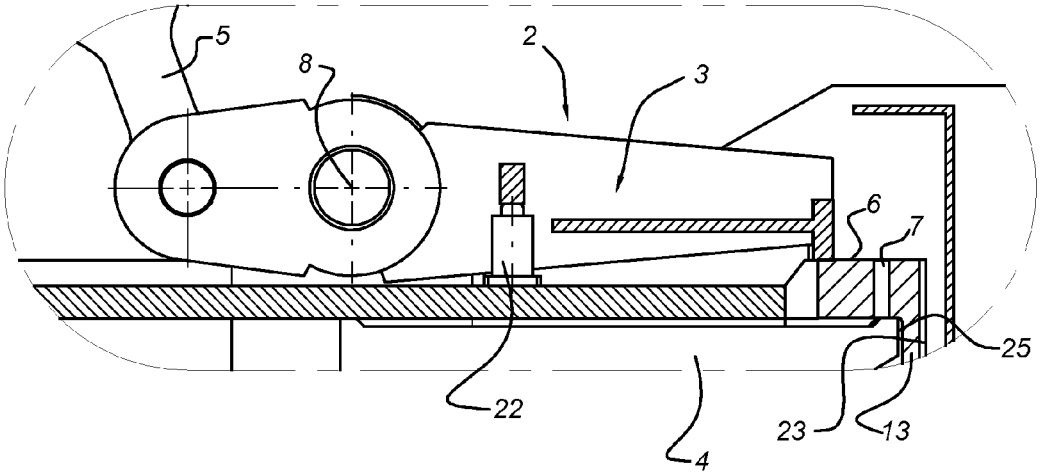
FIG. 4 a detail of FIG. 3.

FIG. 1 shows in perspective view an assembly of a clamping device 1 and a tubular member, here a pile 11 which is partly shown. The hollow pile 11 has a cylindrical pile wall 13. At its shown top end, the pile 11 is provided with a circumferential internal flange 6. Possibly, the pile 11 will be provided with a circumferential flange 6 at both ends of the pile 11 for coupling two adjacent piles 11 by applying bolt connections to holes 7 to constitute e.g. a support for a windmill. Providing an internal flange 6 advantageously place a bolt connection in the interior of the pile 11 preventing corrosion caused by e.g. seawater.

For hoisting the pile 11, the clamping device 1 clamps only at the flange 6 of the pile, therefore no additional measures need be provided with the pile 11 for hoisting the pile 11 which is advantageously.

In this case, the clamping device 1 has four clamping means 2, a different number of clamping means 2 is conceivable as long as the different number of clamping means 2 are arranged and distributed along an imaginary outer circumference of the clamping device 1 for clamping the pile 11 at its flange 6 such that the pile 11 hangs down in a substantially vertical position when hoisting the pile 11 with the clamping device 1. In practice, the imaginary outer circumference of the clamping device 1 corresponds with the circumference 12 of the pile 11 for engagement of the clamping device 1 with the pile 11.

The clamping device 1 comprises a clamping device frame 10 for providing strength to the clamping device 1. The four clamping means 2 are fixedly joined with the clamping device frame 10 for maintaining their mutual position while hoisting a pile 11.

In this case, each of the four clamping means 2 comprise a first 3 and second clamping member 4 for clamping the flange 6, and a coupling member 5 for coupling the clamping means 2 to a hoisting cable (not shown) or link plate for applying a hoisting force F to the clamping device 1. The clamping device 1 is coupled with the hoisting cables or link plates only via the coupling members 5 of the clamping means 2 for providing a secure clamping of the flange 6. The use of link plates facilitates maintaining a proper horizontal position of the clamping device 1 during handling of the clamping device 1 and/or assembly of the clamping device 1 with a pile 11. The hole itself in the first clamping member 3, qualifies for being a "coupling member" as well. As shown in FIG. 1, in this case a shackle is mounted in that hole.

The first clamping member 3 is provided with an upper clamping shoe 18 for engaging the upper side 19 of the flange 6. The second clamping member 4 is provided with a lower clamping shoe 16 for engaging the lower side 15 of the flange. Both the upper and lower clamping shoe 18, 16 protrude from the respective clamping member 3, 4 for providing a controlled and defined engagement with the flange 6.

The second clamping member 4 is hingedly coupled with the first clamping member 3. The second clamping member 4 and the first clamping member 3 are hingedly coupled for mutually hinging these members 3, 4 around a hinging axis 8 for clamping the flange 6 between the upper and lower clamping shoes 16, 18. In this case the first 3 and second clamping member 4 are coupled via the clamping device frame 10 such that the first clamping member 3 hinges relative to the second clamping member 4 and the clamping device frame 10.

In this case, the second clamping member 4 extends past the upper clamping shoe 18 for engaging the flange 6 with the lower clamping shoe 16 more close to the centre line 14 of the tube wall 13 then the upper clamping shoe 18 for reducing bending stresses in the tubular member 11. The lower clamping shoe 16 is spaced form the centre line 14 at a lower clamping shoe distance y, whereas the upper clamping shoe 18 is spaced form the centre line 14 at upper clamping shoe distance x.

Here, the first clamping member 3 extends entirely above the second clamping member 4 providing a more simple construction.

In this case, the clamping device 1 comprises an actuator 22 coupled with both the first and second clamping member 3, 4 for pre-clamping the flange 6 of the tubular member 11 between the lower and upper clamping shoe 16, 18 before hoisting the tubular member 11 by means of the clamping device 1. The actuator 22 is provided between the first and second clamping member 3, 4.

The actuator 22 may also be used for mutually forceably hinging the first and second clamping members 3, 4 towards the open position (not shown) for receiving the flange between the upper and lower clamping shoes 18, 16. This prevents colliding of the upper clamping shoes 18 with the top side 19 of the flange. For the purpose of forceably hinging the first and second clamping members towards the open position, a simple resilient member may be used.

Here, the clamping device 1 comprises a spacing member 20 for mutually spacing the first and second clamping member at a distance that substantially corresponds with a flange thickness of the flange 6 between the upper and lower clamping shoes 16, 18. The first and second clamping members then extend substantially parallel when clamping the flange between the lower and upper clamping shoe which provides a better controlled engagement of the clamping device with the flange 6.

In this case, the second clamping member 4 provided with the lower clamping shoe 16 is slideably coupled with the clamping device frame 10. It is conceivable that the second clamping member is coupled with the clamping device frame 10 in a rolling manner or via a hinging or linkage system, as long as the second clamping member 4 is moveable between a retracted position and an extended position. The second clamping member 4 is slideable between a retracted position (not shown) for moving the second clamping member 4 past the flange 6, and an extended position, see FIG. 3, for the lower clamping shoe 16 facing the lower side 15 of the flange 6. The clamping device frame 10 accommodates an actuation system (not shown) for driving the, in this case four, second clamping members 4. The second clamping members are preferably driven in an evenly manner for further facilitating mutual alignment of the clamping device 1 and the tubular member 11. Here, the clamping device frame 10 comprises an accommodation for slideably accommodating at least partly the second clamping member 4 therein. The second clamping member 4 is coupled with the clamping device frame 10 for closing lines of force for clamping the flange 6 when the second clamping member 4 is in its extended position. Here, the accommodation is integrally formed with the clamping device frame 10.

In this case, the coupling member 5 is provided with the first clamping member 3. Here, the coupling member is a pad-eye hingeably coupled with the first clamping member 3. The hinging axis 8 is arranged between the coupling member 5 and the upper clamping shoe 18 for applying a clamping force $F_1$ at the flange 6 when the hoisting force F is applied at the coupling member 5. The coupling means 5 is spaced from the hinging axis 8 at a coupling means lever a. The upper clamping shoe 18 is spaced from the hinging axis 8 at a upper clamping shoe lever b. The coupling member 5 and the upper and lower clamping shoes 18, 16 are arranged with respect to the hinging axis 8 for subjecting the flange 6 at its transition section 17 with the wall 13 of the tubular member 11 substantially only to tensile stress when hoisting the tubular member 11 with the clamping device 1. A clamping force $F_2$ is applied to the flange 6 at the lower clamping shoe 16.

In this case, the clamping device 1 comprises a stop surface 23 for arranging the clamping device 1 relative to the tube wall 13 for positioning the upper and lower clamping shoes 18, 16 relative to the flange 6 such that the flange 6 at a transition section 17 between the flange 6 and the tube wall 13 is subjected substantially only to tensile stress.

Here, a number of stop surfaces 23 is provided for centring the clamping device 1 within the tubular member 11 for engaging the flange 6 of the tubular member 11.

The clamping device 1 is provided with alignment members 21, here 4 members each at a clamping means 2, for aligning the clamping device 1 with a tubular member 11. Each alignment member 21 is radially aligned with a respective clamping means 2 which is beneficial for positioning the clamping means 2 at the flange 6.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. Clamping device (1) for clamping a tubular member (11), like a thin walled tube or a pile, having a tube wall and provided with a flange (6) at a tube end, and for hoisting said tubular member while clamped only at its flange with the clamping device, wherein the clamping device comprises at least two clamping means (2) for engaging the flange and clamping the flange, a clamping device frame (10) that fixedly joins the at least two clamping means for maintaining mutual position of the at least two clamping means while hoisting the tubular member, and wherein the at least two clamping means are arranged and distributed along an imaginary outer circumference of the clamping device for clamping the tubular member at its flange such that the tubular member hangs down in a substantially vertical position when hoisting the tubular member, wherein each of the at least two clamping means comprise;

a first clamping member (3) provided with an upper clamping shoe (18) for engaging the upper side of the flange, a second clamping member (4) hingedly coupled with the first clamping member and provided with a lower clamping shoe (16) for engaging the lower side of the flange, wherein the first and second clamping members are mutually hingeable around a hinging axis (8) between an open position for receiving the flange between the upper and lower clamping shoes, and a closed position for clamping the flange between the upper and lower clamping shoes, a coupling member (5) for coupling the clamping device with a hoisting element like a hoisting cable or a link plate, and applying a hoisting force (F) to the clamping device, wherein the coupling member is provided with the first clamping member (3) and the hinging axis (8) being arranged between the coupling member (5) and the upper clamping shoe (18) for applying a clamping force at the flange when the hoisting force is applied at the coupling member, wherein the coupling member and the upper and lower clamping shoes are arranged with respect to the hinging axis for subjecting the flange at its transition section with wall of the tubular member substantially only to tensile stress when hoisting the tubular member with the clamping device.

2. Clamping device according to claim 1, wherein the second clamping member extends past the upper clamping shoe for engaging the flange with the lower clamping shoe more close to the tube wall then the upper clamping shoe for reducing bending stresses in the tubular member.

3. Clamping device according to claim 1, comprising a stop surface (23, 25) for arranging the clamping device relative to the tube wall (13) for positioning the upper and lower clamping shoes relative to the flange such that the flange at a transition section (17) between the flange and the tube wall is subjected substantially only to tensile stress.

4. Clamping device according to claim 3, for spacing a lower clamping shoe centre (28) a wall spacing (y) away form a tube wall centre (14).

5. Clamping device according to claim 4, wherein seen in radial direction, a coupling means centre (26) is spaced a coupling means lever (a) from the hinging axis (8), an upper clamping shoe centre (27) is spaced an upper clamping shoe lever (b) from the hinging axis (8), and the lower clamping shoe centre (28) is spaced a clamping shoe spacing (x) from the upper clamping shoe centre (27), wherein the ratio between the coupling means lever (a) and the upper clamping shoe lever (b) corresponds with the ratio of the wall spacing (y) and the clamping shoe spacing (x) for subjecting the flange at its transition section with the tube wall of the tubular member substantially only to tensile stress when hoisting the tubular member with the clamping device.

6. Clamping device according to claim 3, comprising a number of stop surfaces (23) for centring the clamping device within the tubular member for positioning the upper and lower clamping shoes for engaging the flange of the tubular member.

7. Clamping device according to claim 1, wherein the second clamping member of at least one of the at least two clamping means (2), which second clamping member is provided with the lower clamping shoe, is slideably coupled with the clamping device frame, and wherein the second clamping member is slideable radially relative to the imaginary outer circumference of the clamping device between a retracted position for moving the second clamping member past the flange, and an extended position for the lower clamping shoe facing the lower side of the flange.

8. Clamping device according to a claim 7, wherein the clamping device frame comprises an accommodation for slideably accommodating at least partly the second clamping member therein, and for coupling the second clamping member with the clamping device frame for closing lines of force for clamping the flange when the second clamping member is in its extended position.

9. Clamping device according to claim 8, wherein the accommodation is integrally formed with the clamping device frame.

10. Clamping device according to claim 1, wherein the first clamping member extends entirely above the second clamping member.

11. Clamping device according to claim 1, comprising an actuator coupled with both the first and second clamping member for pre-clamping the flange of the tubular member between the lower and upper clamping shoe before hoisting the tubular member by means of the clamping device.

12. Clamping device according to claim 11, wherein the actuator is provided between the first and second clamping member.

13. Clamping device according to claim 1, comprising a spacing member (20) for mutually spacing the first and second clamping member at a distance such that the first and second clamping members extend substantially parallel when clamping the flange between the lower and upper clamping shoe.

14. Clamping device according to claim 13, wherein the distance substantially corresponds with a flange thickness of the flange.

15. Assembly of a clamping device according to claim 1 and a tubular member clamped with the clamping device at a flange of the tubular member.

16. Method for hoisting a flanged tubular member (11) using a clamping device (1) according to claim 1, comprising the step, moving the lower clamping shoe (16) radially towards the tube wall (13).

17. Method for hoisting a flanged tubular member (11) using a clamping device (1) according to claim 2, comprising the step, moving the lower clamping shoe (16) radially towards the tube wall (13).

18. Method for hoisting a flanged tubular member (11) using a clamping device (1) according to claim 3, comprising the step, moving the lower clamping shoe (16) radially towards the tube wall (13).

19. Method for hoisting a flanged tubular member (11) using a clamping device (1) according to claim 4, comprising the step, moving the lower clamping shoe (16) radially towards the tube wall (13).

20. Method for hoisting a flanged tubular member (11) using a clamping device (1) according to claim 5, comprising the step, moving the lower clamping shoe (16) radially towards the tube wall (13).

* * * * *